US010076225B2

(12) United States Patent
Naik

(10) Patent No.: US 10,076,225 B2
(45) Date of Patent: Sep. 18, 2018

(54) DISHWASHER WITH SPRAYER

(71) Applicant: Whirpool Corporation, Benton Harbor, MI (US)

(72) Inventor: Sujit S. Naik, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 823 days.

(21) Appl. No.: 14/104,339

(22) Filed: Dec. 12, 2013

(65) Prior Publication Data

US 2015/0164299 A1 Jun. 18, 2015

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
CPC ..... A47L 15/22; A47L 15/23
See application file for complete search history.

(56) References Cited

U.S. PATENT DOCUMENTS

| | | | | |
|---|---|---|---|---|
| 3,677,473 | A | 7/1972 | Belaieff | |
| 4,175,575 | A | 11/1979 | Cushing | |
| 5,415,350 | A | 5/1995 | Yoon et al. | |
| 5,655,556 | A * | 8/1997 | Guerrera | A47L 15/23 134/176 |
| 5,673,714 | A | 10/1997 | Campagnolo et al. | |
| 5,964,232 | A | 10/1999 | Chung | |
| 8,349,089 | B2 | 1/2013 | Bertsch et al. | |
| 2011/0146734 | A1 | 6/2011 | Rappette | |
| 2013/0074886 | A1 | 3/2013 | Feddema et al. | |
| 2013/0074887 | A1 | 3/2013 | Feddema | |
| 2013/0074888 | A1 | 3/2013 | Feddema | |
| 2013/0074890 | A1 | 3/2013 | Feddema et al. | |
| 2013/0074891 | A1 | 3/2013 | Bertsch et al. | |

FOREIGN PATENT DOCUMENTS

| | | | |
|---|---|---|---|
| EP | 1334687 | A1 | 8/2003 |
| EP | 2292134 | A1 | 3/2011 |
| GB | 2199734 | A | 7/1988 |
| JP | 2600447 | A | 2/1992 |
| JP | 8089467 | A | 4/1996 |
| KR | 200156558 | Y1 | 9/1999 |
| KR | 100258614 | B1 | 7/2000 |
| KR | 100258616 | B1 | 7/2000 |

* cited by examiner

*Primary Examiner* — Rita P Adhlakha
(74) *Attorney, Agent, or Firm* — McGarry Bair PC

(57) ABSTRACT

A dishwasher for washing dishes according to an automatic cycle of operation, includes a tub at least partially defining a treating chamber for receiving dishes for cleaning and a spraying system supplying liquid to the treating chamber and having at least one sprayer having a body mounted within the tub for rotation about a rotational axis and defining an interior, a liquid passage provided in the interior, and at least one moveable nozzle carried by the body and having at least one outlet in fluid communication with the liquid passage and a drive mechanism therefor.

20 Claims, 10 Drawing Sheets

DISHWASHER WITH SPRAYER

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The spraying system may include various sprayers including a rotatable sprayer.

SUMMARY

An embodiment of the invention relates to a dishwasher for washing dishes according to an automatic cycle of operation, includes a tub at least partially defining a treating chamber for receiving dishes for cleaning and a spraying system supplying liquid to the treating chamber and having at least one sprayer having a body mounted within the tub for rotation about a rotational axis and defining an interior, a liquid passage provided in the interior, and at least one moveable nozzle carried by the body and having at least one outlet in fluid communication with the liquid passage and a drive mechanism operably carried by the body and coupled to the at least one moveable nozzle to move the at least one moveable nozzle such that emissions from the at least one outlet are directed in multiple directions.

DESCRIPTION OF EMBODIMENTS OF THE INVENTION

Figure 1:
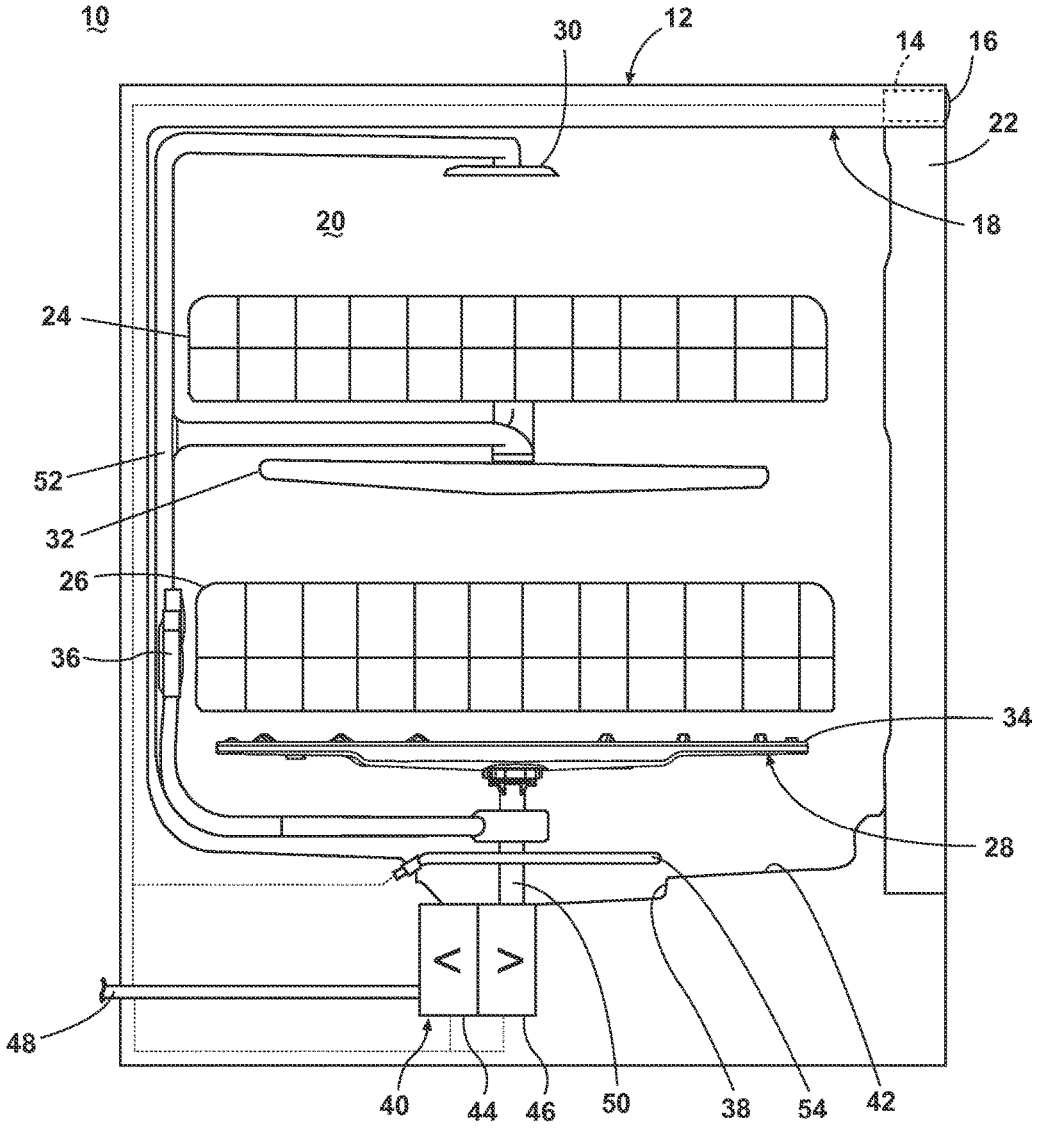
FIG. 1 is a schematic view of a dishwasher with a spray system according to an embodiment of the invention.

Referring to FIG. 1, an automatic dishwasher 10 having a cabinet 12 defining an interior is illustrated. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
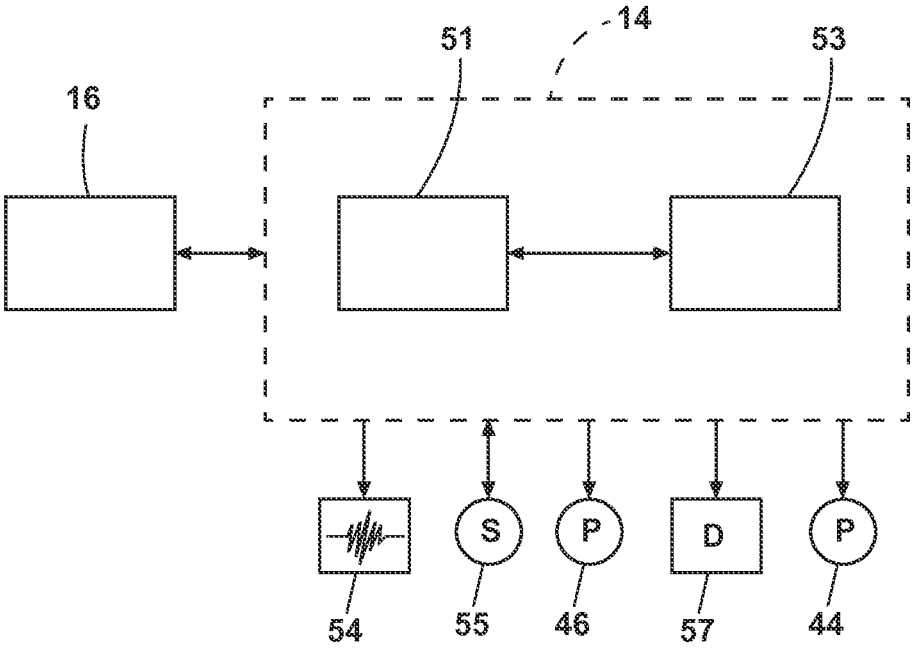
FIG. 2 is a schematic view of a control system of the dishwasher of FIG. 1.

As illustrated in FIG. 2, the controller 14 may be provided with a memory 51 and a central processing unit (CPU) 53. The memory 51 may be used for storing control software that may be executed by the CPU 53 in completing a cycle of operation using the dishwasher 10 and any additional software. For example, the memory 51 may store one or more pre-programmed cycles of operation, that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step, or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 55. Non-limiting examples of optional sensors 55 that may be communicably coupled with the controller 14 include a moisture sensor, a door sensor, a temperature sensor, a detergent and rinse aid presence/type sensor(s). The controller 14 may also be coupled to a dispenser 57, which may dispense a detergent during the wash step of the cycle of operation or a rinse aid during the rinse step of the cycle of operation.

Figure 3:
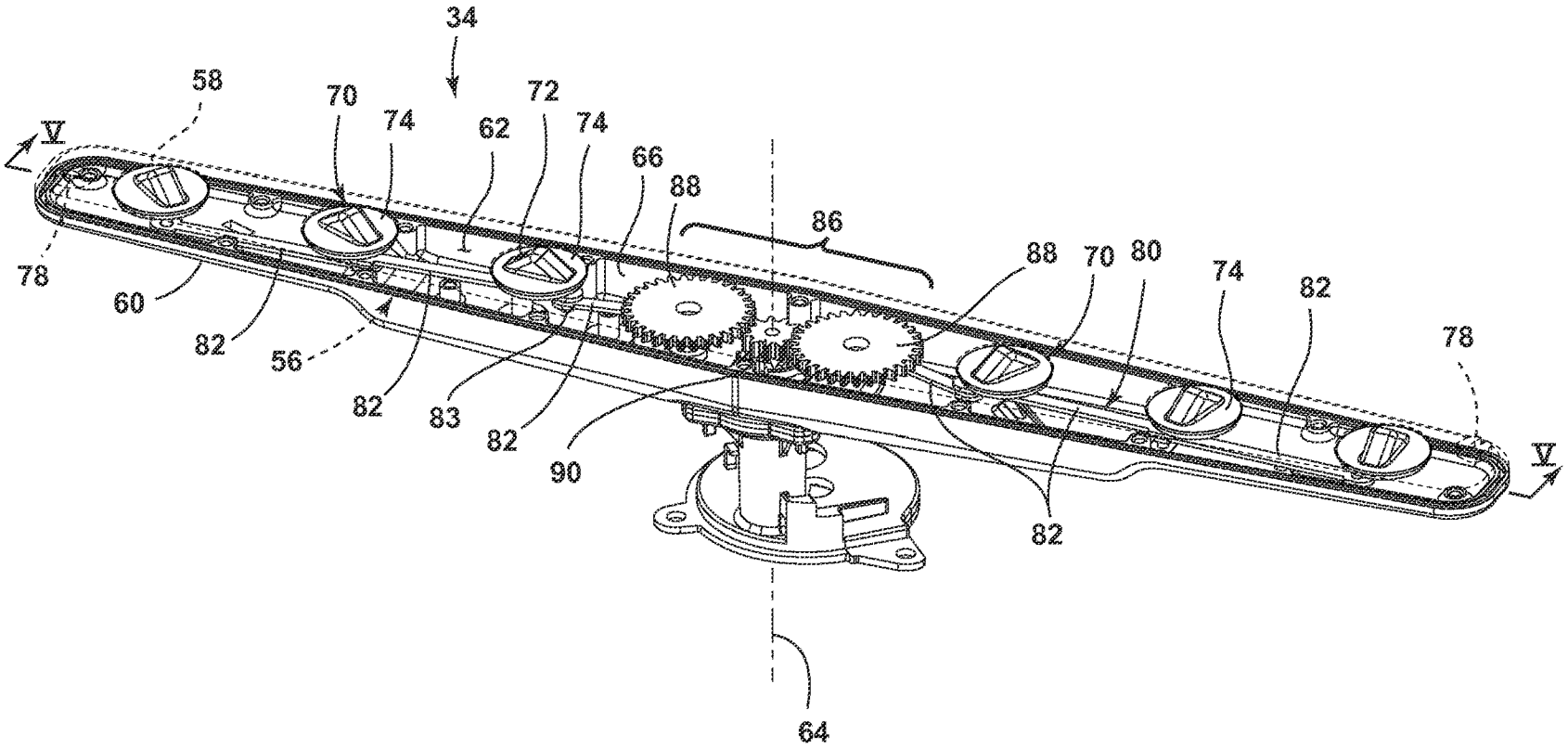
FIG. 3 is a perspective view of a rotatable spray arm of the spray system of the dishwasher of FIG. 1.
Figure 4:
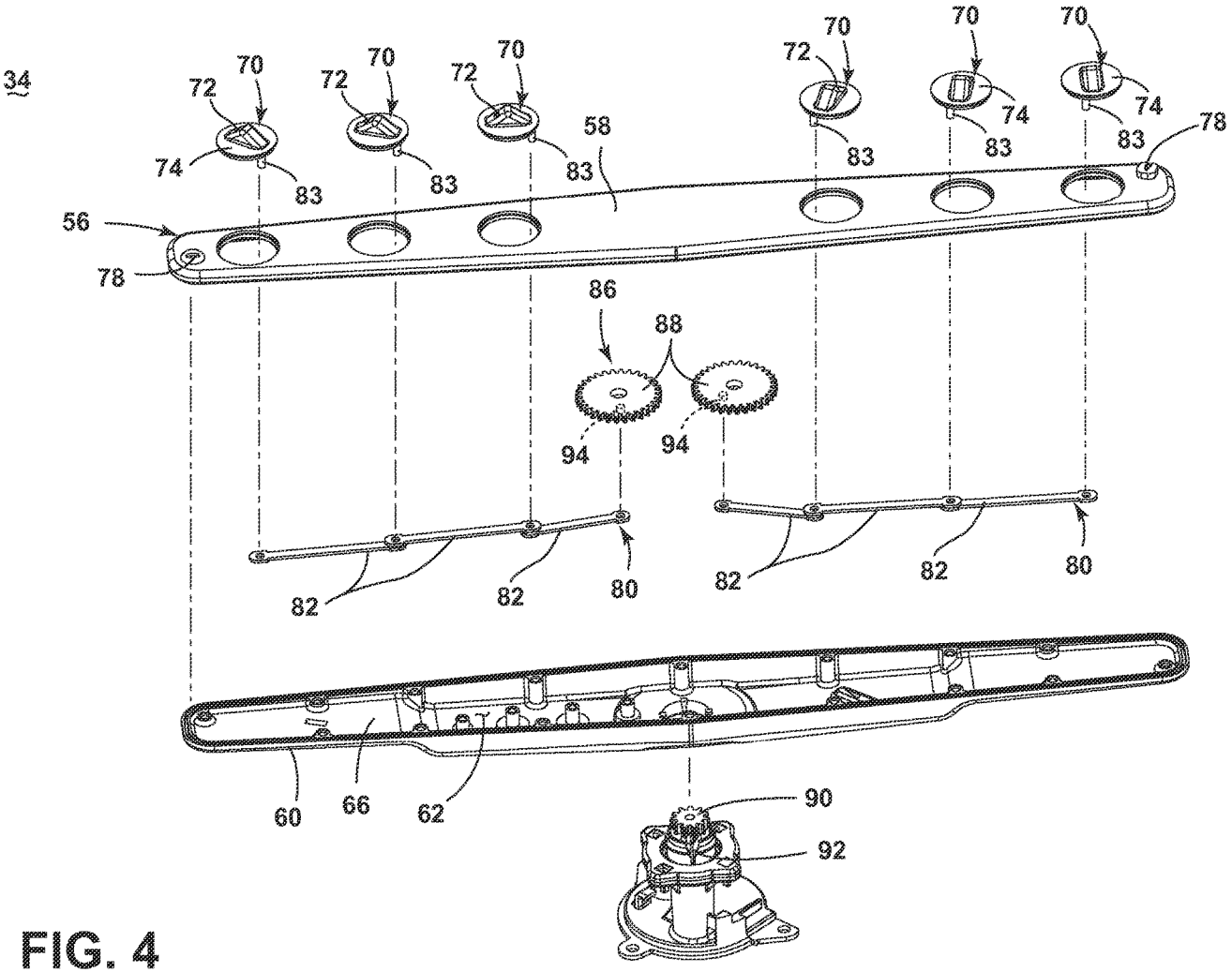
FIG. 4 is an exploded view of the rotatable spray arm of FIG. 3.

FIG. 3 illustrates a perspective view of one embodiment of the lower rotatable spray arm 34 having a body 56 having an upper surface 58, a lower surface 60, and an interior 62. The body 56 may be mounted within the tub 18 for movement about a rotational axis 64. A liquid passage 66 may be provided in the interior 62 and may fluidly couple with the outlet conduit 50 and recirculation pump 46. As illustrated, the interior 62 defines the liquid passage 66. However, a separate liquid passage 66 may be located within the interior 62.

At least one moveable nozzle 70, having an at least one outlet 72, may be carried by the body 56 and may be in fluid communication with the liquid passage 66. In the illustrated example, a plurality of moveable nozzle(s) 70 have been included in the body 56. The plurality of moveable nozzle(s) 70 may be located and spaced in any suitable manner on the body 56. In the illustrated example, the number of moveable nozzle(s) 70 on each half of the body 56 are the same although this need not be the case. The moveable nozzles may be formed and may move in any suitable manner. By way of non-limiting example, the plurality of moveable nozzle(s) 70 have been illustrated as rotatable nozzles 74. While each of the rotatable nozzles 74 has been illustrated as having a disk shape, it is contemplated that the rotatable nozzles 74 may have any suitable shape. Further, while each of the rotatable nozzles 74 has been illustrated as including a single outlet 72 it will be understood that the rotatable nozzles 74 may include multiple outlets.

It will be understood that the moveable nozzle(s) 70 may be carried by the body 56 in any suitable manner. For example, the moveable nozzle(s) 70 may be operably coupled to the body 56 or otherwise formed therein. By way of non-limiting example, a rivet fastener may be utilized to allow the moveable nozzle(s) 70 to be rotatably attached to the body 56. Further, the moveable nozzle(s) 70 may be sealed with the body 56 in any suitable manner including that they may have a leak proof attachment to the body 56.

Further still, a variety of non-moveable nozzles may be included on the body 56. Such non-moveable nozzles may include nozzles configured for spraying liquid onto dishes within the treating chamber as well as hydraulic drive nozzles 78. More specifically, a hydraulic drive may be formed by one or more hydraulic drive nozzles 78, which may be oriented such that liquid emitted from the one or more hydraulic drive nozzles 78 effects the rotation of the lower rotatable spray arm 34. It will be understood that the lower rotatable spray arm 34 may have any number of hydraulic drive nozzles 78 and that these hydraulic drive nozzles 78 may be located such that when the recirculation pump 46 is activated, the lower rotatable spray arm 34 rotates. To generate the greatest torque, the hydraulic drive nozzles 78 may be located near the tip of the body 56, which is the greatest distance from the axis of rotation. While the hydraulic drive nozzles 78 have been illustrated as being located on the upper surface 58 of the body, it has also been contemplated that such hydraulic drive nozzles 78 may be located on various portions of the body 56 including a side or bottom portion of the body 56.

A drive mechanism 80 may be operably coupled to the moveable nozzle(s) 70 to move the moveable nozzle(s) 70 such that emissions from the at least one outlet 72 are directed in multiple directions. The drive mechanism 80 may be moveable relative to the body 56. In the illustrated example, the drive mechanism 80 includes multiple links 82 operably coupled to the plurality of moveable nozzle(s) 70. More specifically, a pin 83 extending from each of the moveable nozzles is operably coupled with one or more of the links 82. The pins 83 are located off of the rotational axis of the moveable nozzle 70, allowing the reciprocation of the link to rotate the moveable nozzle 70. In the illustrated example, the drive mechanism 80 is located within the body 56 although this need not be the case.

Further, the drive mechanism 80 may be operably coupled to the rotating spray arm 34 such that rotation of the spray arm 34 operates the drive mechanism 80. In the illustrated example, a gear train 86 is included in the drive mechanism 80 and operably couples to the links 82 to move the links 82 based on the rotation of the spray arm 34. More specifically, rotation of the lower rotatable spray arm 34 moves the gear train 86, which in turn moves the links 82. Thus, the gear train 86 helps convert the rotational motion of the lower rotatable spray arm 34 into sliding motion of the links 82. In this manner, the gear train 86 acts as an actuator to move the moveable nozzle(s) 70 based on the rotation of the body 56. It will be understood that the drive mechanism 80 may include any suitable mechanism(s) capable of moving the moveable nozzle(s) 70 based on the rotation of the lower rotatable spray arm 34.

Figure 5:
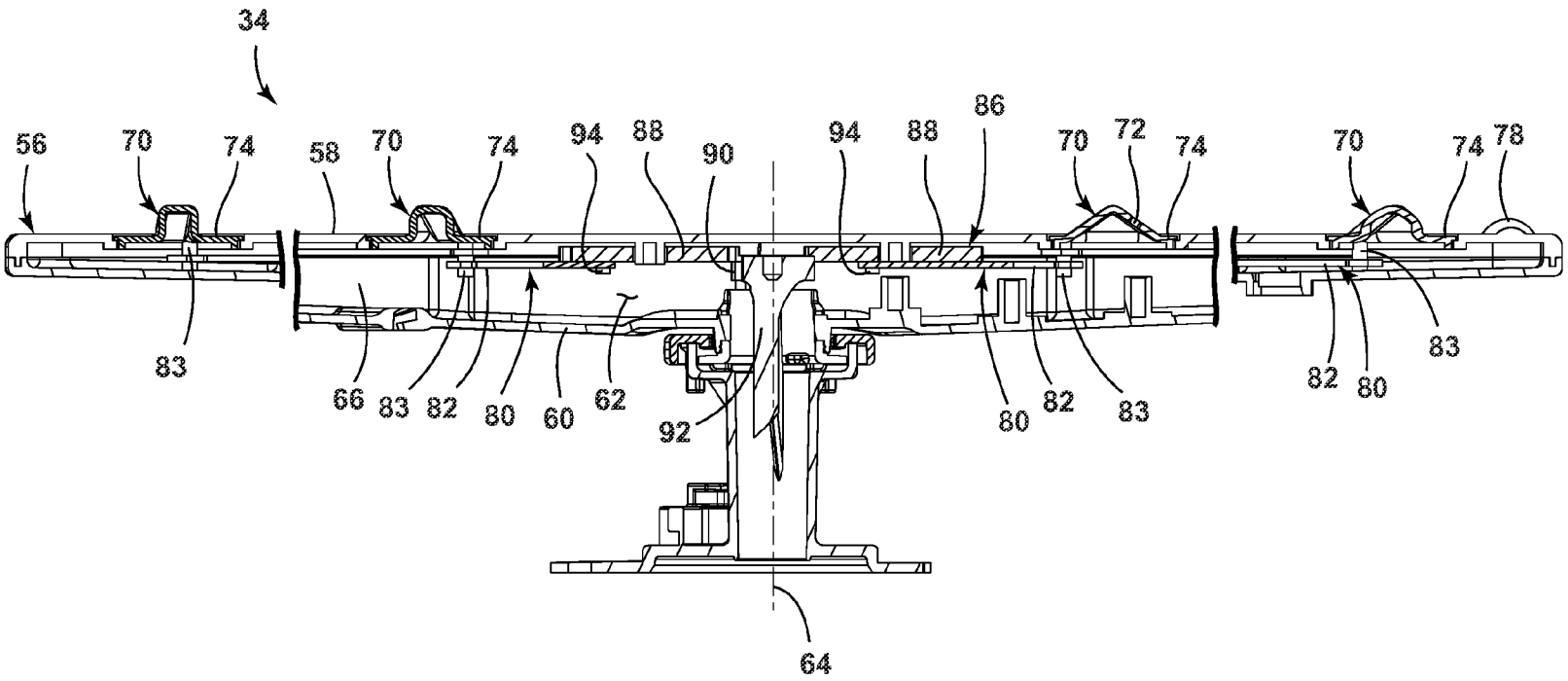
FIG. 5 is a cross-sectional view of the rotatable spray arm of FIG. 3.

The gear train 86 has been illustrated as including a pair of first gears 88 and a fixed gear 90. A fixed shaft 92 may extend through a portion of the body 56 such that the lower rotatable spray arm 34 is rotationally mounted on the fixed shaft 92. Further, the fixed gear 90 may be fixedly mounted on the fixed shaft 92. The fixed gear 90 may form a sun gear around which each of the first gears 88 rotate. As more clearly shown in FIG. 5, a pin 94 may extend from each of the first gears 88. Each pin 94 may be operably coupled with a link 82 on either side of the body 56.

It will be understood that the moveable nozzle(s) 70 and drive mechanism 80 may be modified in any suitable manner. In the illustrated example, three different links 82 are utilized. Different link lengths may be utilized to accommodate difference pin locations on the rotatable nozzles 74 and allow different degrees of rotation for each rotatable nozzle 74. In the illustrated embodiment, the pin location on the first gear 88 and on the rotatable nozzles 74 are defined to give a 160-degree range of rotation to the rotatable nozzles 74 as the first gear 88 rotates 360 degrees. As the pin 94 on the first gear 88 moves radially outward the degree of rotation of the rotatable nozzles 74 will increase. The radial distance of the pin 93 on the rotatable nozzles 74 may also be changed to increase or decrease the degree of rotation of the rotatable nozzles 74. The radial distance of the pin 94 on the first gear 88 may be less than the radial distance of the pin 83 on the rotatable nozzle 74 to prevent locking of the drive mechanism 80.

While separate links 82 for each of the moveable nozzle(s) 70 have been illustrated, it will be understood that any number of links 82 may be utilized. For example, a single piece linkage may be utilized. In one exemplary embodiment, such a single linkage may form a parallelogram mechanism making the rotatable nozzles 74 rotate 360 degrees when the first gear 88 rotates 360 degrees. This may be the case if the radial distance of the pin 94 location on the first gear 88 is the same as the radial distance of the pin 83 on the rotatable nozzles 74. Further, it will be understood that regardless of how many links 82 are utilized, the links 82 may be designed so that they do not overlap with the outlet of the moveable nozzles such that they do not block the flow during movement of the moveable nozzle 70.

The operation of the dishwasher 10 with the lower rotatable spray arm structure as illustrated will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

The lower rotatable spray arm 34 may rely on liquid pumped from the recirculation pump 46 to provide hydraulic drive to rotate the lower rotatable spray arm 34, which through the drive mechanism 80 allows for motion of the moveable nozzle(s) 70. As the lower rotatable spray arm 34 is hydraulically rotated about the fixed shaft 92, each of the first gears 88 move with the rotation of the lower rotatable spray arm 34 such that they are driven around the fixed gear 90. Thus, the first gears 88 are also hydraulically driven and may be caused to circle about the fixed gear 90 as the lower rotatable spray arm 34 rotates about the fixed shaft 92. As the first gears 88 rotate, the pins 94 rotate within the interior 62 of the lower rotatable spray arm 34. As the pins 94 rotate, links 82 are moved within the interior 62 of the lower rotatable spray arm 34. In this manner, the drive mechanism 80 moves within the body 56 based on the rotation of the body 56.

Figure 6A:
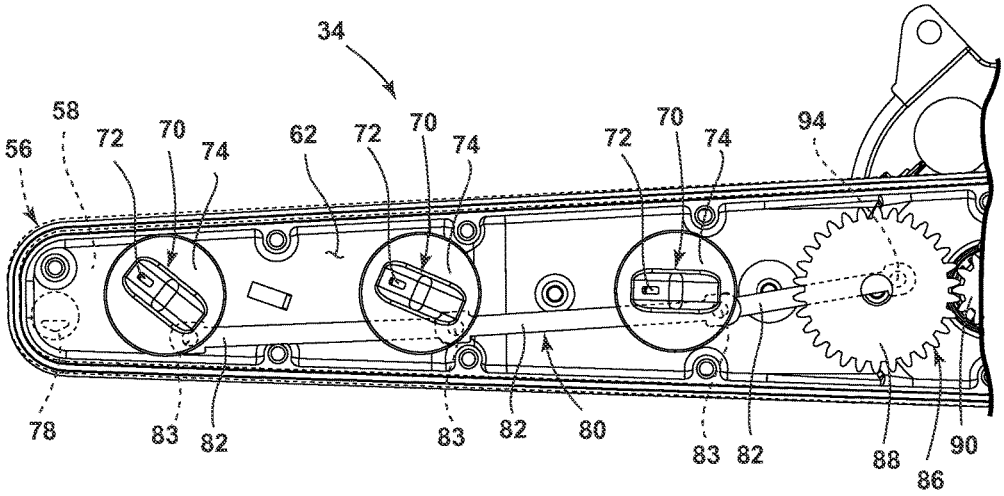
FIGS. 6A-6B are top views of the rotatable spray arm of FIG. 3 illustrating moveable nozzles and a drive mechanism in various positions.
Figure 6B:
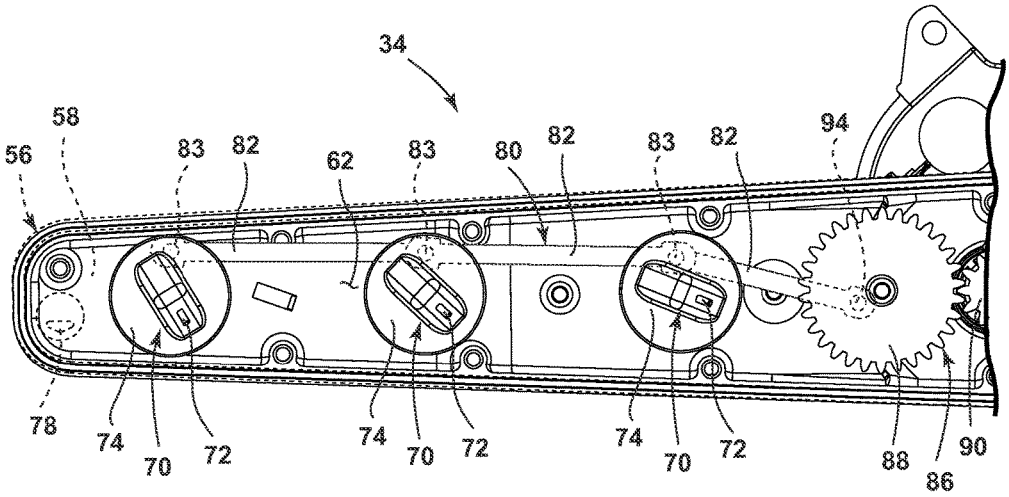

More specifically, as the first gears 88 make a full rotation, the pin 94 pushes and pulls on the links 82, which in turn cause the moveable nozzle(s) 70 to oscillate back and forth. As the links 82 are pushed and pulled, the outlet 72 of the rotatable nozzles 74 may be rotated between a first position (FIG. 6A) and a second position (FIG. 6B). Thus, in the illustrated example, the rotatable nozzles 74 are rotatable between first and second positions by the drive mechanism 80 within a 160 degree range of motion. In such an instance, it is contemplated that the moveable nozzle(s) 70 may spray only on a front side of the dishes within the tub 18. It will be understood that the drive mechanism including any links therein as well as the moveable nozzle(s) 70 may be modified to provide a smaller or larger range of motion including that the moveable nozzle(s) 70 may make a full 360 degree rotation.

The gear train 86 may be formed in any suitable manner including that the gear train 86 may be a reduction gear train where the moveable nozzle(s) 70 are moved between the two positions over multiple rotations of the lower rotatable spray arm 34. The gear ratios of the gear train 86 may be selected in any suitable manner to control the relative movement of the drive mechanism 80 to the lower rotatable spray arm 34.

As the lower rotatable spray arm 34 turns, the drive mechanism 80 continues to move between the first and second positions and the moveable nozzle(s) 70 continue to oscillate. The movement of the lower rotatable spray arm 34 and the drive mechanism 80 ends when fluid is no longer pumped by the recirculation pump 46 to the lower rotatable spray arm 34 such that the lower rotatable spray arm 34 is no longer hydraulically driven.

Alternatively, instead of being hydraulically driven, a drive system may be included to control the rotation of the lower rotatable spray arm 34. Such a drive system may be motor-driven. For example, an electric motor (not shown) may be provided externally of the tub 18 and may be operably coupled to a portion of the lower rotatable spray arm 34 to rotate the lower rotatable spray arm 34. If the lower rotatable spray arm 34 is motor operated, the drive mechanism 80 may be moved as the lower rotatable spray arm 34 rotates regardless of the flow rate provided by the recirculation pump 46. A motor driven lower rotatable spray arm 34 may be useful in instances where no hydraulic drive outlets are provided. Such a motor driven lower rotatable spray arm 34 may also allow for longer dwell times. In this manner, zonal washing, may be accomplished within the treating chamber 20 because the motor may have the ability to manipulate the speed of rotation of the lower rotatable spray arm 34 such that the controller 14 may control the spray emitted from the moveable nozzles 70 in pre-selected areas of the treating chamber 20.

Figure 7:
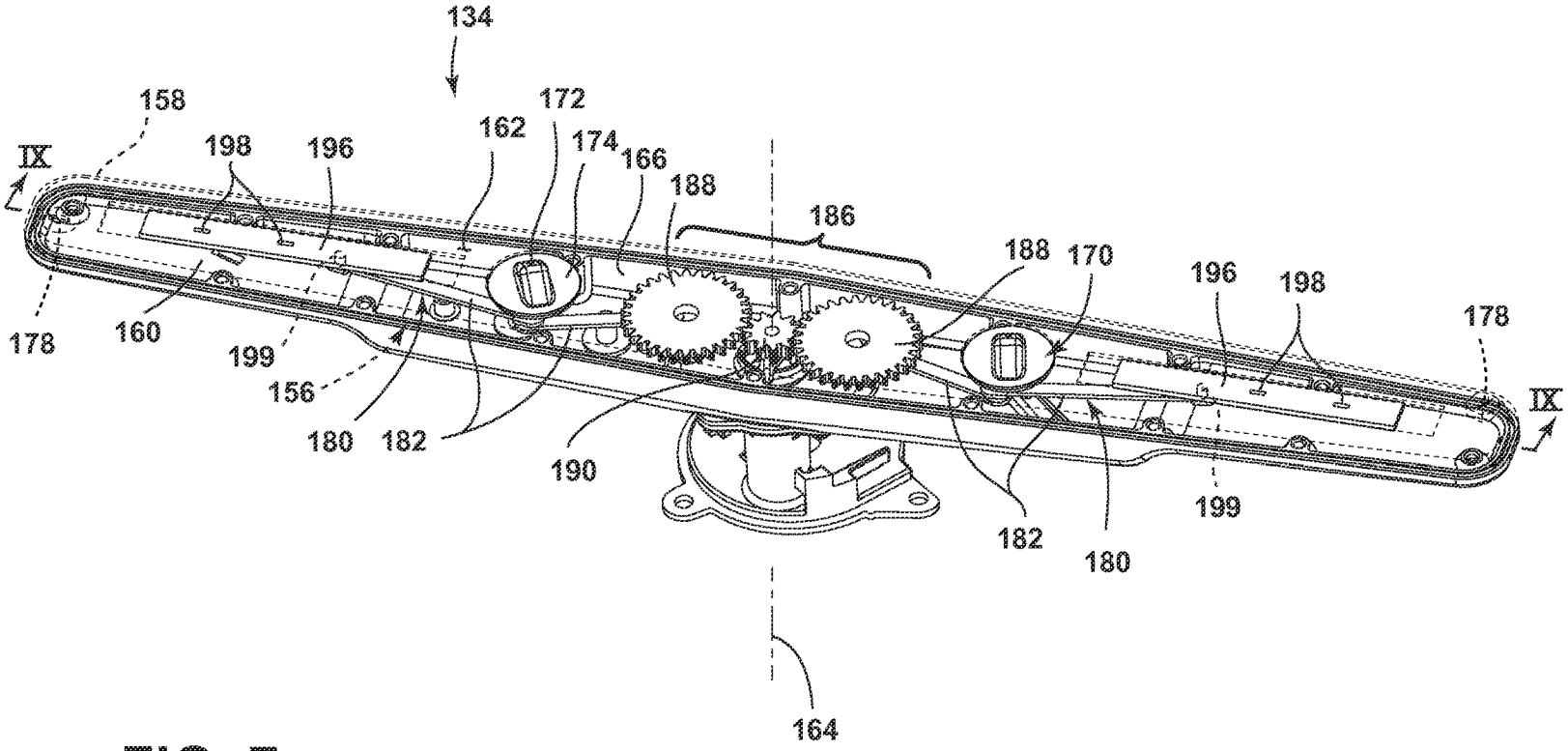
FIG. 7 is a perspective view of a rotatable spray arm according to another embodiment that may be used in the dishwasher of FIG. 1.

FIG. 7 illustrates a perspective view of an alternative rotatable spray arm 134 according to another embodiment of the invention, which may be used in the dishwasher 10. The rotatable spray arm 134 is similar to the rotatable spray arm 34 previously described and therefore, like parts will be identified with like numerals increased by 100, with it being understood that the description of the like parts of the rotatable spray arm 34 applies to the rotatable spray arm 134, unless otherwise noted.

Figure 8:
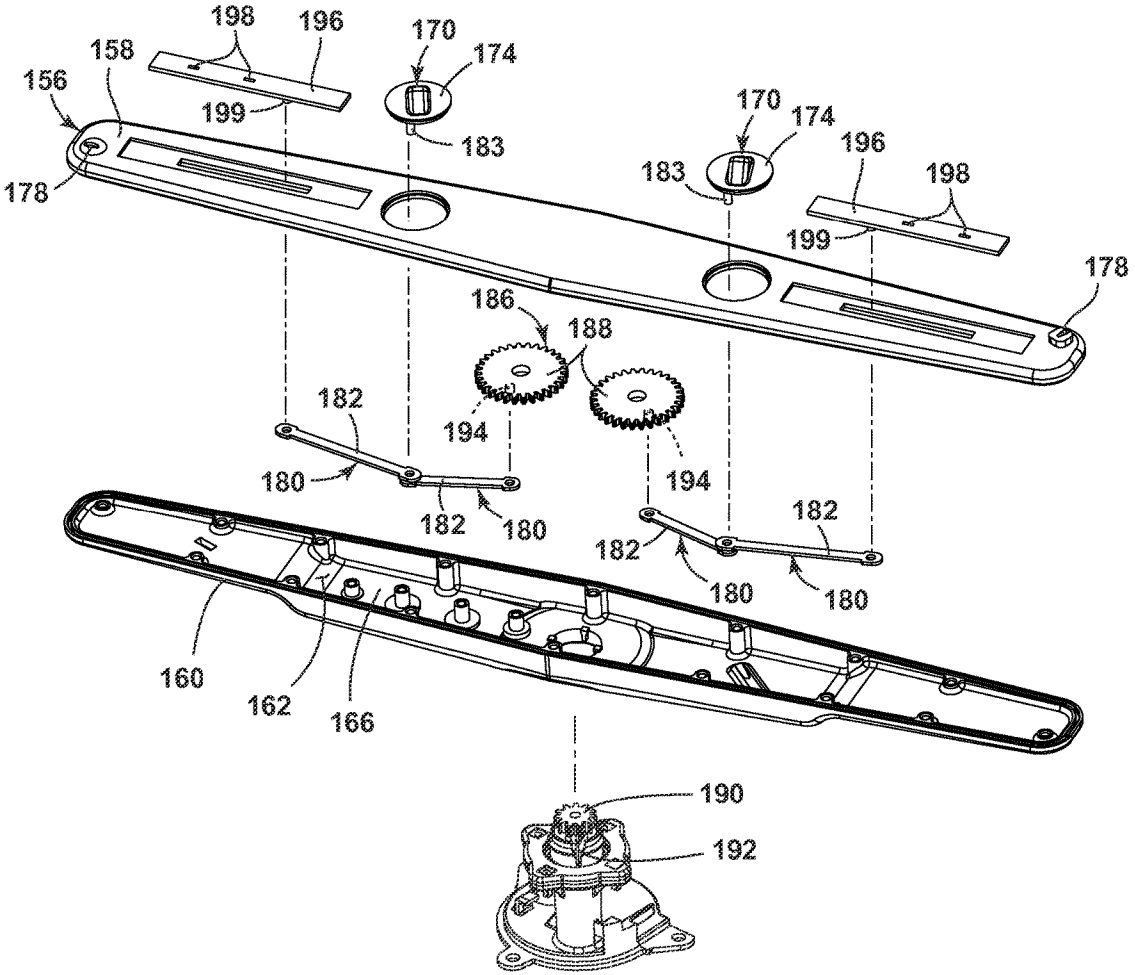
FIG. 8 is an exploded view of the rotatable spray arm of FIG. 3.

One difference is that the moveable nozzle(s) 170 include both rotatable nozzles 174 and slidable nozzles in the form of plates 196. Each plate 196 may have at least one outlet 198 and as the plate 196 moves the spray emitted from the at least one outlet 198 may be directed in multiple directions. It will be understood that the plate 196 may have any number of outlets 198 including two as illustrated. The plate 196 may be formed in any suitable manner. For example, the plate 196 may include a rigid plate, a flexible plate, or a thin film plate, which may be either flexible or rigid. Further, while the plate 196 has been illustrated in FIG. 8 as being located above an upper surface 158 of the body 156 it is contemplated that the plate 196 may be located within the body 156. In such an instance, the plate 196 may include a membrane with the openings formed therein and which may conform to the shape of the body 156 and may form a liquid seal between the portions of the body 156 and the liquid passage 166.

Figure 9:
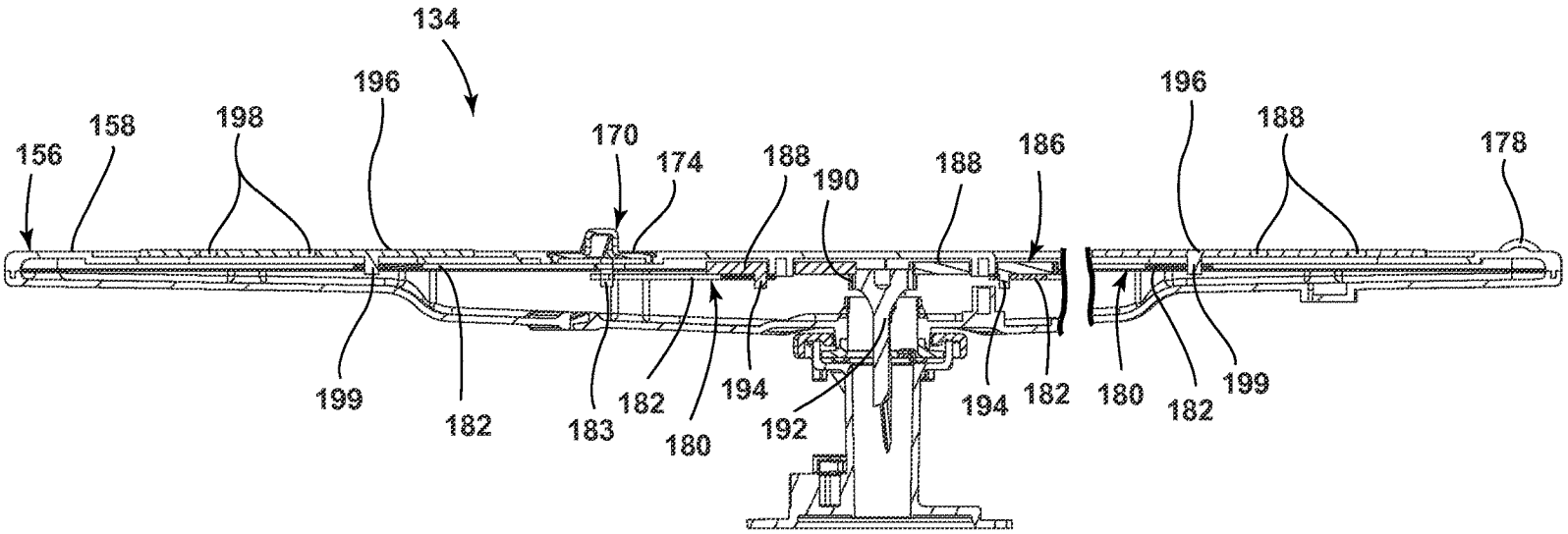
FIG. 9 is a cross-sectional view of the rotatable spray arm of FIG. 3.
Figure 10A:
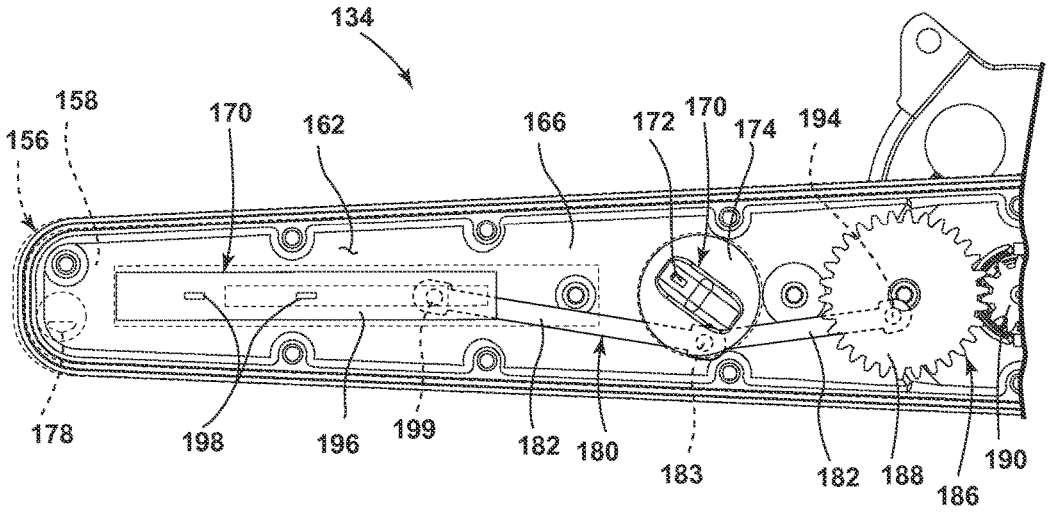
FIGS. 10A-10B are top views of the rotatable spray arm of FIG. 3 illustrating moveable nozzles and a drive mechanism in various positions.
Figure 10B:
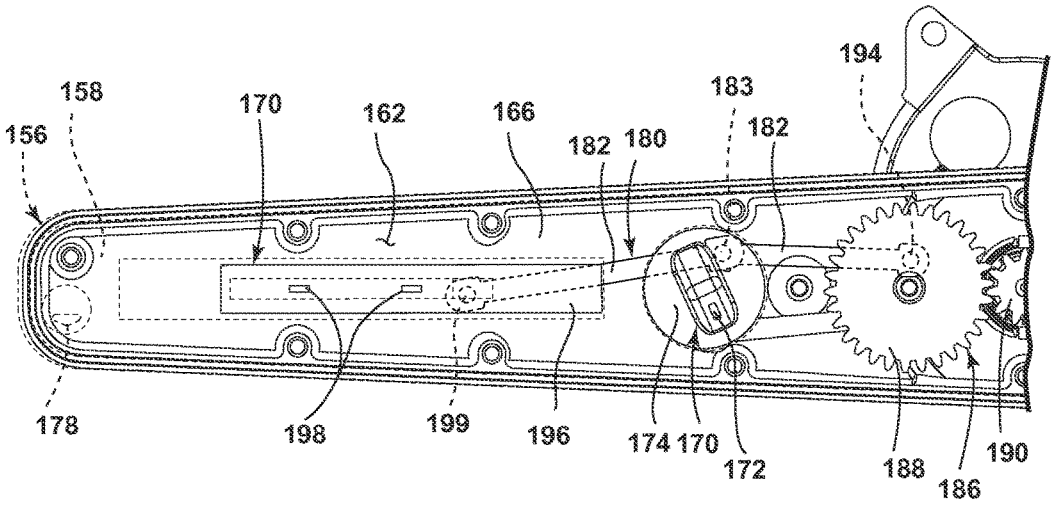

As shown in FIG. 9, the plate 196 may include a pin 199, which may be operably coupled to a link 182 of the drive mechanism 180. The plate 196 and drive mechanism 180 may be designed in any suitable manner such that the plate 196 may be slid in any suitable manner. This may include that the plate 196 may be reciprocated between a first position (FIG. 10A) and a second position (FIG. 10B) by the drive mechanism 180, as illustrated.

The spray arm 134 and moveable nozzle(s) 170 operate much in the same way as the previously described spray arm. As the lower rotatable spray arm 134 is rotated, hydraulically or otherwise, about the fixed shaft 192, each of the first gears 188 move and are driven around the fixed gear 190. In turn, the pins 194 rotate and the links 182 are moved causing both the rotatable nozzles 174 and the plates 196 to move to change the direction of spray from the moveable nozzle(s) 170.

While the embodiments described and illustrated above are with respect to the lower rotatable spray arm, it will be understood that embodiments of the invention may be used with respect to any rotatable sprayer in the dishwasher. Further, while the body has been described with respect to a single body it is contemplated that embodiments of the invention may be utilized with a spiral graph type spray arm for further improving the spray coverage and wash performance. Further still, while the drive mechanism has been described as being operably coupled to the rotating spray arm such that rotation of the spray arm operates the drive mechanism it will be understood that the moveable nozzle may include a hydraulic drive. For example, in the embodiment where the moveable nozzles rotate this may allow the moveable nozzles to rotate 360 degrees without any control on their degree of rotation.

There are several advantages of the present disclosure arising from the various features of the apparatuses described herein. For example, the embodiments described above allow for moveable nozzles, which may spray in multiple directions. This allows the spray to cover more area within the treating chamber and reach in areas of the rack including the corners while still having a small number of nozzles. The embodiments above provide better coverage of the treating chamber without utilizing more water and while maintaining cleaning pressure. Further, embodiments of the invention may be used with a controllable spray arm for sensorial washing where spray may be directed at particular locations in the dishwasher.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. Further, while the invention has been specifically described in connection with certain specific embodiments thereof, it is to be understood that this is by way of illustration and not of limitation. For example, other drive mechanisms may be used to control the movement of the moveable nozzles based on the rotation of the rotatable body and the illustrated drive mechanisms are merely exemplary.

The patentable scope of the invention is defined by the claims, and may include other examples that occur to those skilled in the art. It will be understood that any features of the above-described embodiments may be combined in any manner. Reasonable variation and modification are possible within the scope of the forgoing disclosure and drawings without departing from the spirit of the invention, which is defined in the appended claims.

What is claimed is:

1. A dishwasher for washing dishes according to an automatic cycle of operation, comprising:

a tub at least partially defining a treating chamber for receiving dishes for cleaning; and a spraying system supplying liquid to the treating chamber and having at least one sprayer comprising:

a body mounted within the tub for rotation about a rotational axis and defining an interior;

a liquid passage provided in the interior;

at least one stationary hydraulic drive nozzle that is stationary with respect to the body and oriented within the body such that liquid emitted from the at least one stationary hydraulic drive nozzle effects the rotation of the body;

and at least one rotatable wash nozzle, separate from the at least one stationary hydraulic drive nozzle, inset in an upper surface of the body and separately moveable with respect to the upper surface of the body and having at least one outlet in fluid communication with the liquid passage; and a drive mechanism operably coupled to the body and including at least one of a gear or link physically coupled to the at least one rotatable wash nozzle to move the at least one rotatable wash nozzle with respect to the body and wherein movement of the body about the rotational axis physically drives the at least one of the gear or link, which is in turn rotates the at least one rotatable wash nozzle about a vertical axis parallel to the rotational axis such that emissions from the at least one outlet are directed in multiple directions with respect to the body.

2. The dishwasher of claim 1 wherein the drive mechanism is located within the body.

3. The dishwasher of claim 1 wherein the at least one rotatable wash nozzle comprises a plurality of rotatable wash nozzles, rotatable about respective vertical axes.

4. The dishwasher of claim 3 wherein the rotatable nozzles are rotatable between first and second positions.

5. The dishwasher of claim 4 wherein the first and second positions provide about a 160 degree range of motion.

6. The dishwasher of claim 3 wherein at least one of the rotatable wash nozzles comprises a plate having at least one outlet and wherein the plate fluidly seals with an opening in an upper surface of the body.

7. The dishwasher of claim 6 wherein the plate is reciprocated between first and second positions by the drive mechanism.

8. The dishwasher of claim 3 wherein the drive mechanism comprises multiple links operably coupled to the plurality of rotatable wash nozzles.

9. The dishwasher of claim 1 wherein the sprayer comprises a rotating spray arm, with a portion of the rotating spray arm defining the body.

10. The dishwasher of claim 1 wherein the drive mechanism comprises a gear train.

11. The dishwasher of claim 10 wherein the drive mechanism further comprises a link coupling the gear train to the at least one rotatable wash nozzle.

12. The dishwasher of claim 1 wherein the gear includes a fixed sun gear located within the interior and about which at least one other gear of the drive mechanism rotates.

13. The dishwasher of claim 1 wherein the at least one rotatable wash nozzle has a 160-degree range of rotation about the vertical axis.

14. A dishwasher for washing dishes according to an automatic cycle of operation, comprising:

a tub at least partially defining a treating chamber for receiving dishes for cleaning; and a spraying system supplying liquid to the treating chamber and having at least one sprayer comprising:

a spray arm having an elongated body with at least two opposing tips and where the elongated body is mounted within the tub for rotation about a rotational axis and where the elongated body defines an interior;

a liquid passage provided in the interior; and a plurality of moveable nozzles carried by the elongated body and spaced along a length of the elongated body, the plurality of moveable nozzles separately rotatable with respect to the elongated body about separate vertical axes, and where the plurality of moveable nozzles are located radially interior of the at least two opposing tips, and each of the plurality of moveable nozzles having at least one outlet in fluid communication with the liquid passage; and a drive mechanism including a gear train operably carried by the elongated body and coupled to the plurality of moveable nozzles to rotate the plurality of moveable nozzles with respect to the elongated body and wherein movement of the elongated body about the rotational axis drives the gear train, which is in turn configured to rotate the plurality of moveable nozzles about the separate vertical axes, which are parallel to the rotational axis during operation of the automatic cycle of operation such that emissions from the at least one outlet of the plurality of moveable nozzles are directed in multiple directions to spray the dishes in the multiple directions.

15. The dishwasher of claim 14 wherein the spray arm is hydraulically driven.

16. The dishwasher of claim 14 wherein the drive mechanism comprises multiple links, with a first of the multiple links operably coupling the gear train to a first of the plurality of moveable nozzles and a second of the multiple links operably coupling the first of the plurality of moveable nozzles to the second of the plurality of moveable nozzles.

17. A dishwasher for washing dishes according to an automatic cycle of operation, comprising:

a tub at least partially defining a treating chamber for receiving dishes for cleaning; and a spraying system supplying liquid to the treating chamber and having at least one sprayer comprising:

a spray arm having an elongated body with two opposing tips and where the elongated body is mounted within the tub for rotation about a rotational axis and defining an interior;

a liquid passage provided in the interior;

at least one hydraulic drive nozzle located on one of the two opposing tips of the elongated body and oriented such that liquid emitted from the at least one hydraulic drive nozzle creates a torque acting on the spray arm that effects the rotation of the elongated body;

and at least one rotatable nozzle having a plate portion carried by an upper surface of the elongated body and having a pin extending from a lower surface of the plate portion into the interior of the elongated body, where the at least one rotatable nozzle is separately moveable within the upper surface of the elongated body, and the at least one rotatable nozzle is located radially interior of the two opposing tips, and the at least one rotatable nozzle has at least one outlet in fluid communication with the liquid passage; and a drive mechanism located within the interior of the elongated body and coupled to the at least one rotatable nozzle via the pin and wherein rotation of the elongated body about the rotational axis provides input that is transferred via the drive mechanism to the pin of the at least one rotatable nozzle and rotates the at least one rotatable nozzle about a parallel vertical axis within the upper surface of the elongated body as the elongated body itself is rotated about the rotational axis during operation of the automatic cycle of operation such that emissions from the at least one outlet are directed in multiple directions to spray the dishes in the multiple directions.

18. The dishwasher of claim 17 wherein the at least one rotatable nozzle comprises a plurality of rotatable nozzles located radially interior of the two opposing tips.

19. The dishwasher of claim 18 wherein the drive mechanism comprises multiple links operably coupled to the plurality of rotatable nozzles.

20. The dishwasher of claim 19 wherein the multiple links allow different degrees of rotation for at least some of the plurality of rotatable nozzles.

* * * * *